US012434895B2

(12) United States Patent
Jesberg et al.

(10) Patent No.: US 12,434,895 B2
(45) Date of Patent: Oct. 7, 2025

(54) CLOSING CAP ARRANGEMENT

(71) Applicant: Seidel GmbH & Co. KG, Marburg (DE)

(72) Inventors: Silke Jesberg, Wetter (DE); Andreas Ritzenhoff, Marburg (DE); Michael Kurz, Neustadt-Speckswinkel (DE); Tobias Huehn, Marburg (DE)

(73) Assignee: SEIDEL GMBH & CO. KG, Marburg (DE)

( * ) Notice: Subject to any disclaimer, the term of this patent is extended or adjusted under 35 U.S.C. 154(b) by 0 days.

(21) Appl. No.: 17/336,989

(22) Filed: Jun. 2, 2021

(65) Prior Publication Data

US 2021/0394969 A1 Dec. 23, 2021

(30) Foreign Application Priority Data

Jun. 2, 2020 (DE) ..... 10 2020 114 652.3

(51) Int. Cl.

| | |
|---|---|
| ***B65D 41/16*** | (2006.01) |
| ***A45D 34/04*** | (2006.01) |
| ***A45D 40/00*** | (2006.01) |
| ***A45D 40/26*** | (2006.01) |
| ***A46B 9/02*** | (2006.01) |
| ***A46B 15/00*** | (2006.01) |
| ***B65D 41/04*** | (2006.01) |

(Continued)

(52) U.S. Cl.

CPC ..... *B65D 77/0486* (2013.01); *A45D 34/046* (2013.01); *A45D 40/0068* (2013.01); *A45D 40/267* (2013.01); *A46B 9/021* (2013.01); *A46B 15/0095* (2013.01); *B65D 41/045* (2013.01); *B65D 41/0478* (2013.01); *B65D 41/62* (2013.01); *A46B 2200/1053* (2013.01); *B65D 2251/0015* (2013.01); *B65D 2251/0078* (2013.01); *B65D 2251/20* (2013.01)

(58) Field of Classification Search

CPC ..... B65D 41/16; B65D 41/165; B65D 41/18; B65D 41/185; B65D 41/62; B65D 2251/0015; B65D 2251/0078; B65D 2251/0046

USPC ..... 215/335

See application file for complete search history.

(56) References Cited

U.S. PATENT DOCUMENTS

RE6,613 E * 8/1875 Fry ..... 215/335
1,646,765 A * 10/1927 Ramsey ..... B65D 41/16 215/321

(Continued)

FOREIGN PATENT DOCUMENTS

CA 2263123 A1 * 9/1999 ..... B65D 81/3823
DE 1069486 B 11/1959

(Continued)

*Primary Examiner* — Allan D Stevens

(74) *Attorney, Agent, or Firm* — Dickinson Wright PLLC; Andrew D. Dorisio

(57) ABSTRACT

The invention relates to a closing cap arrangement (80) for being disposed on an outlet opening of a vessel realised as a pot or a bottle, the closing cap arrangement having a multipart design, the closing cap arrangement comprising an enveloping cap (81) and an inner cap (82) provided with a connective element for detachably connecting the closing cap arrangement to the outlet opening and realised independently of the enveloping cap, the inner cap and the enveloping cap being connected to each other via a detachable connection realised as a form-fit, substance-to-substance or force-fit connection.

6 Claims, 20 Drawing Sheets

(51) Int. Cl.
*B65D 41/62* (2006.01)
*B65D 77/04* (2006.01)

(56) References Cited

U.S. PATENT DOCUMENTS 1,998,870 A * 4/1935 Hammer ..... B65D 41/16 215/352
2,974,815 A * 3/1961 Driscoll ..... B65D 47/265 222/548
3,651,972 A 3/1972 Itoh
4,039,097 A * 8/1977 Venti ..... B65D 83/40 215/386
4,607,757 A * 8/1986 Lecinski ..... B65D 41/08 53/442
5,176,278 A * 1/1993 Quarberg ..... B65D 51/20 220/729
6,010,026 A * 1/2000 Diekhoff ..... B21D 51/40 215/44
6,105,817 A * 8/2000 Ponton ..... B65D 83/40 220/784
7,909,236 B2 * 3/2011 Erdie ..... B65D 59/02 229/125.17
10,835,012 B2 * 11/2020 Schlatter ..... A45D 34/04
2006/0186081 A1 * 8/2006 Reed ..... B65D 41/0492 215/230
2007/0131738 A1 * 6/2007 Erdie ..... B65D 59/02 229/125.17
2010/0290827 A1 * 11/2010 Komatsuda ..... A45D 40/06 401/98
2012/0292283 A1 * 11/2012 Kornbrust ..... B65D 41/26 215/387
2015/0158622 A1 * 6/2015 Martinengo ..... B65D 41/0492 215/276
2015/0320943 A1 11/2015 Barber
2019/0329948 A1 10/2019 Ritzenhoff
2021/0047085 A1 * 2/2021 Jin ..... A45D 40/00
2022/0000248 A1 * 1/2022 Jesberg ..... A45D 40/0068
2022/0161971 A1 * 5/2022 Azuma ..... B65D 41/0492
2022/0185551 A1 * 6/2022 Vila Vilalta ..... B65D 51/18
2022/0211161 A1 * 7/2022 Del Din ..... B65D 51/18
2022/0411137 A1 * 12/2022 Jesberg ..... B65D 41/0414

FOREIGN PATENT DOCUMENTS

DE 7835907 U1 3/1979
DE 2938094 A1 4/1981
EP 3034430 A1 6/2016
FR 2160344 A1 6/1973
GB 371727 A 4/1932
KR 800001916 Y1 11/1980
KR 2009008583 U * 8/2009 ..... B65D 41/62
WO 2007060325 A1 5/2007
WO WO-2014016391 A1 * 1/2014 ..... B65D 41/62

* cited by examiner

CLOSING CAP ARRANGEMENT

TECHNICAL FIELD

The invention relates to a closing cap arrangement for being disposed on an outlet opening of a vessel realised as a pot or a bottle, the closing cap arrangement having a multipart design, the closing cap arrangement comprising an enveloping cap and an inner cap provided with a connective element for detachably connecting the closing cap arrangement to the outlet opening and realised independently of the enveloping cap.

BACKGROUND

Closing cap arrangements of the type mentioned above are commonly realised as material hybrids, which means that the closing cap arrangements, which are made of a plurality of components, comprise components which consist of different materials. In most instances, the closing cap arrangements are mostly material hybrids or material mixes made of aluminium and plastic, meaning an effective recycling presumes separating the materials in particular in the case when the respective material portion exceeds a certain range. Separating the materials often proves time-consuming, in particular when separating the materials cannot be carried out economically means sacrificing the inferior or less valuable material to enable recycling the more valuable material portion. This can occur, for example, when closing cap arrangements, which have aluminium and plastic components, are molten for recycling purposes so that the material is separated in this case by burning or gasifying the plastic portion.

An extensive recycling of a closing cap arrangement made of several components becomes possible using two different approaches, for example, the closing cap arrangement of the first approach being designed such that the individual components can be separated from each other as easily as possible, while the second approach strives for a plastic portion as small as possible to limit the non-recyclable portion of the closing cap arrangement to a minimum when sacrificing plastic material.

SUMMARY

The object of the present invention is therefore to propose a closing cap arrangement which enables a simplified recycling of the used materials and is distinguished by a particularly high portion of recyclable materials.

According to the invention, the inner cap and the enveloping cap are connected to each other via a detachable connection, which can be realised as a form-fit, substance-to-substance or force-fit connection, so that the closing cap arrangement according to the invention does not have to be supplied to the recycling process as a whole unit, but instead the components can be separated before recycling takes place owing to the material intersections for the subsequent supply of the components to different recycling methods or non-recyclable materials or materials which can only be recycled with great effort can be separated from the materials which are comparatively better suited for recycling.

The closing cap arrangement according to the invention also makes possible to reduce a plastic portion to a range as small possible, e.g., less than 10 percent, and to choose a uniform recycling method for the other components, in particular in the case when these materials consist of a uniform material, such as in particular aluminium.

In any case, the closing cap arrangement according to the invention consequently simplifies recycling.

It is particularly advantageous if the enveloping cap and the inner cap are connected to each other by their lower edges via concentric contact surfaces, so that on the one hand the material intersections are easily accessible when producing and dissolving the connection and on the other hand the connection takes place at a position which is commonly not visible when the closing cap arrangement is disposed on a pot, since the front face of the closing cap arrangement formed by the lower edges of the enveloping cap and the inner cap commonly limits a shadow groove formed towards the pot.

It is particularly advantageous if the inner cap comprises a sealing disk disposed on a cap bottom, the inner cap having a locking groove, which protrudes radially inward, adjacent to the cap bottom, for fixating the sealing disk so that when the sealing disk is made of a shape-elastic material, the sealing disk is automatically connected to the inner cap upon mounting of the sealing disk and can be easily separated.

Preferably, a cap insert, which is realised as a sleeve and forms a separate entity of mass, is disposed in a gap formed between the inner cap and the enveloping cap.

It is particularly preferable if the cap insert comprises a radial inner and a radial outer contact surface for forming a connection to a sleeve part of the inner part and a sleeve part of the enveloping cap so that it is possible to connect large areas of the inner cap and the enveloping cap, meaning in particular that the material of the inner cap and the enveloping cap can be as thin as possible.

Preferably, the cap insert has ribs, which extend parallel to the centre axis of the cap insert, on its inner and/or its outer contact surface so that sufficiently large holding forces can be produced in the area of the ribs, the holding forces enabling a consistently durable, exclusively force-fit connection between the cap insert and the inner cap and the enveloping cap when necessary.

If the cap insert is partially realised as a plastic part at least in the area of its contact surfaces, a thermal connection can be produced between the inner cap and the enveloping cap without the use of additional material upon having chosen the suitable plastic.

It is particularly advantageous if the cap insert is realised as a cap weight in order to increase the quality of the closing cap arrangement for the user via the corresponding effect on how the closing cap arrangement feels.

If the enveloping cap comprises a cap bottom formed independently of a jacket envelope and the inner cap forms a connective element for connecting the jacket envelop to the cap bottom, it becomes possible to produce a complex closing cap arrangement of the same or different materials, which can be separated at defined connecting positions if required.

It is particularly advantageous if the inner cap comprises a cap base, which forms the connective element for a connection to the outlet opening, and a connective sleeve for connecting the enveloping sleeve to the cap base, the connective sleeve being disposed concentrically to a sleeve part of the cap base and being received in the enveloping sleeve in order to form a gap. Because of the differentiation made between a cap base, which serves for a connection to the outlet opening, and a connective sleeve, which enables the connection between the cap base and the jacket envelope, the respective components of the closing cap arrangement can be optimised with respect to their differing functions. At the same time, the percentage by mass of the inner cap formed by the connective sleeve can be minimised in comparison to the overall mass of the inner cap, so that the percentage by mass, which remains between the cap bottom and the jacket envelope of the enveloping cap, can be potentially sacrificed in particular when the cap base is separated from the closing cap arrangement. This applies in particular when, for example, the jacket envelope and the cap bottom of the enveloping cap are made of the same material, such as in particular aluminium, and the inner cap is made of a plastic material.

If both the connection between the cap bottom and the connective sleeve and the connection between the jacket envelope and the connective sleeve are realised as locking connections, the individual components making up the closing cap arrangement can be separated particularly easily.

Preferably, the inner cap has a screw thread for realising the connective element of the connection to the outlet opening comprises.

If the inner cap is made up of multiple parts and has a collar realised as a sleeve and serves for being disposed on the outlet opening or a dispense element disposed in the outlet opening and has a push-on cap for a preferably force-fit position on the collar, the closing cap arrangement can also be used for vessels which do not have their own connective element. If required, it is also possible to provide a substance-to-substance connection between the push-on cap and the outlet opening or the outlet element.

It proves to be particularly advantageous if the push-on cap comprises a sleeve part having at least one spring cam, which comprises two slots, which are disposed opposite each other in a wall of the sleeve part for forming a cam base, and a cam, which is directed radially inward on the cam base. In a particularly easy manner, the cam can be produced during production of the push-on cap by the cam being produced by an indentation in a sleeve wall. Preferably, several cams distributed across the circumference can be provided.

Preferably, the slots each comprise a horizontal section extending in the circumferential direction of the sleeve part and two vertical sections extending from the ends of the horizontal section towards each other, the slots alternatively being able to extend vertically.

If the push-on cap comprises multiple spring cams preferably distributed across the circumference, a holding force evenly distributed across the circumference is possible.

If the collar is provided with a locking groove, which extends circumferentially and is directed radially inward and which serves for locking with the spring cam disposed in the sleeve part of the push-on cap, a secure locking connection between the collar and the push-on cap is possible independently of the rotational position of the push-on cap to the collar, as long as the spring cam and the locking groove are located in a shared horizontal plane.

Preferably, the spring cam is disposed between two spacing elements, which are preferably formed by vertical grooves protruding radially outward, so that a free space is formed by the spacing elements for the swerving movement of the spring cam when disposed on the collar and the swerving movement of the cam is not prevented by an enveloping cap disposed on the push-on cap.

If the spacing element simultaneously serves for connecting the push-on cap to the enveloping cap, the spacing element takes up an advantageous double function.

Preferably, a sleeve-shaped cap insert is received in a gap formed between the push-on cap and the enveloping cap. It is particularly advantageous, if the cap insert serves for connecting the enveloping cap to the push-on cap.

The function of the cap insert for connecting the enveloping cap to the push-on cap becomes advantageously enabled if the cap insert comprises vertical ribs on both its inner surface and its outer surface, the ribs providing an effective clamp between the components in the event of a force-fit connection and, if applicable, enabling realising defined adhesive surfaces when the connection is realised as an adhesive connection.

Preferably, the enveloping cap comprises at least one horizontal circumferential groove, which protrudes radially inward, on a sleeve part in such a manner that cross sections, which enable the definition of contact points or connective points limited in particular locally, are formed between the circumferential groove and the ribs via the cap insert being disposed in the gap.

It is particularly preferable if the cap inner part is formed as a clamping sleeve in an upper sleeve section, the clamping sleeve having a clamping cross section deviating in contour from a circular cross section of a collar, on which the push-on cap is disposed.

If the clamping cross section comprises at least one flattening, which deviates from a circular cross section, such that the diameter of the clamping cross section is smaller in the area of the flattening than the outer diameter of the collar, producing the required clamping force can be enabled using particularly simple means.

It is particularly advantageous if the clamping cross section has a plurality of flattenings distributed across the circumference, such that a clamping force correspondingly distributed across the circumference is the result.

To attain a clamping force, which acts evenly across the height of the sleeve section formed as a clamping sleeve, it is advantageous if a cross over section is formed for realising a cross-section cross over from an opening edge of the cap inner par to the sleeve section formed as a clamping sleeve, the cross over section forming the cross-section cross over from the circular cross section in the area of the opening edge to the clamping cross section of the clamping sleeve. Consequently, it can be ensured that the clamping force is formed essentially constant across the height of sleeve section realised as a clamping sleeve.

In the following, preferred embodiments of the closing cap arrangement are described in more detail using the drawings.

DETAILED DESCRIPTION

Figure 1:
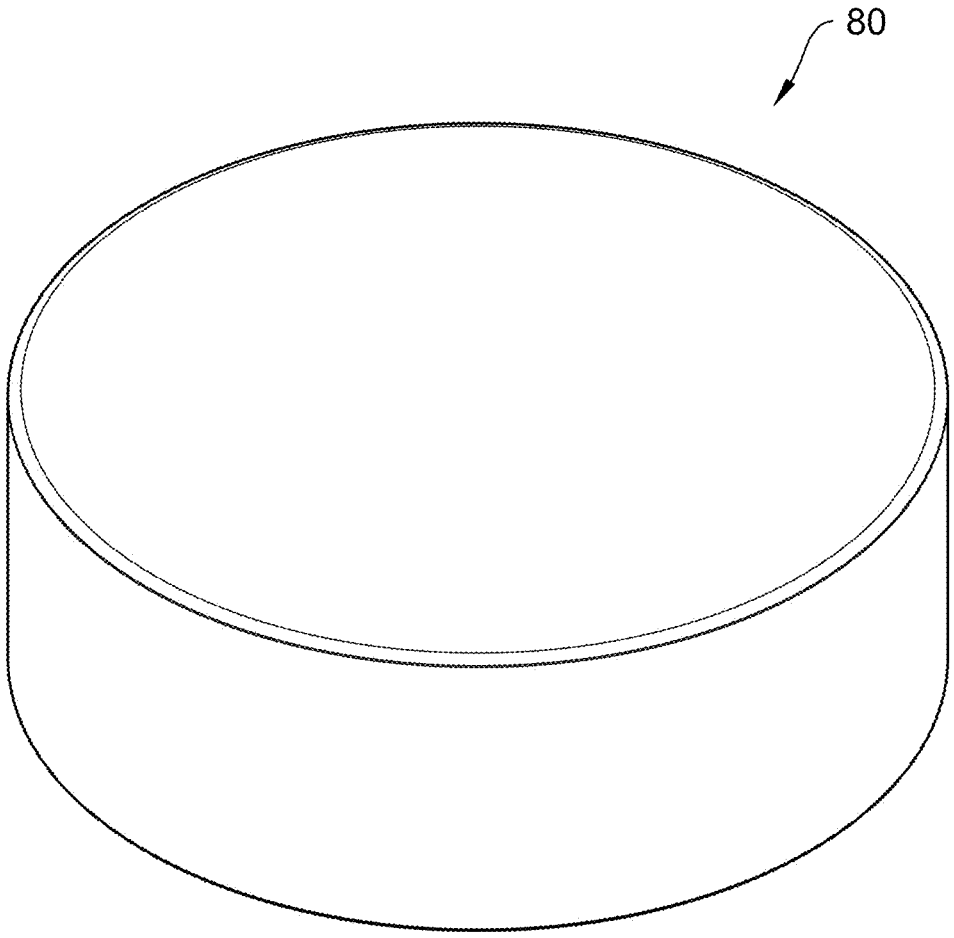
FIG. 1 shows an isometric view of a closing cap arrangement according to a first embodiment.
Figure 2:
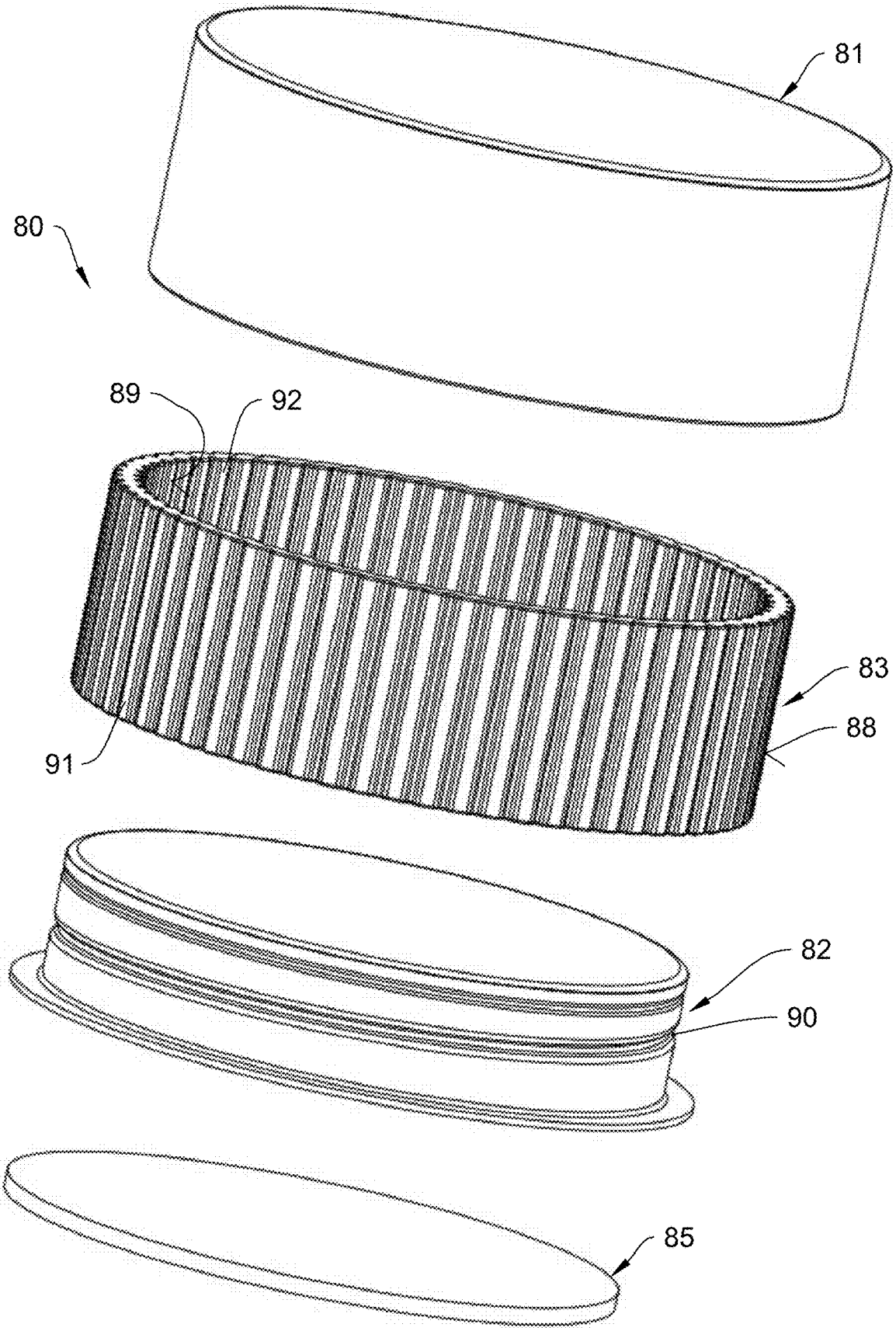
FIG. 2 shows an exploded view of the closing cap arrangement shown in FIG. 1.
Figure 3:
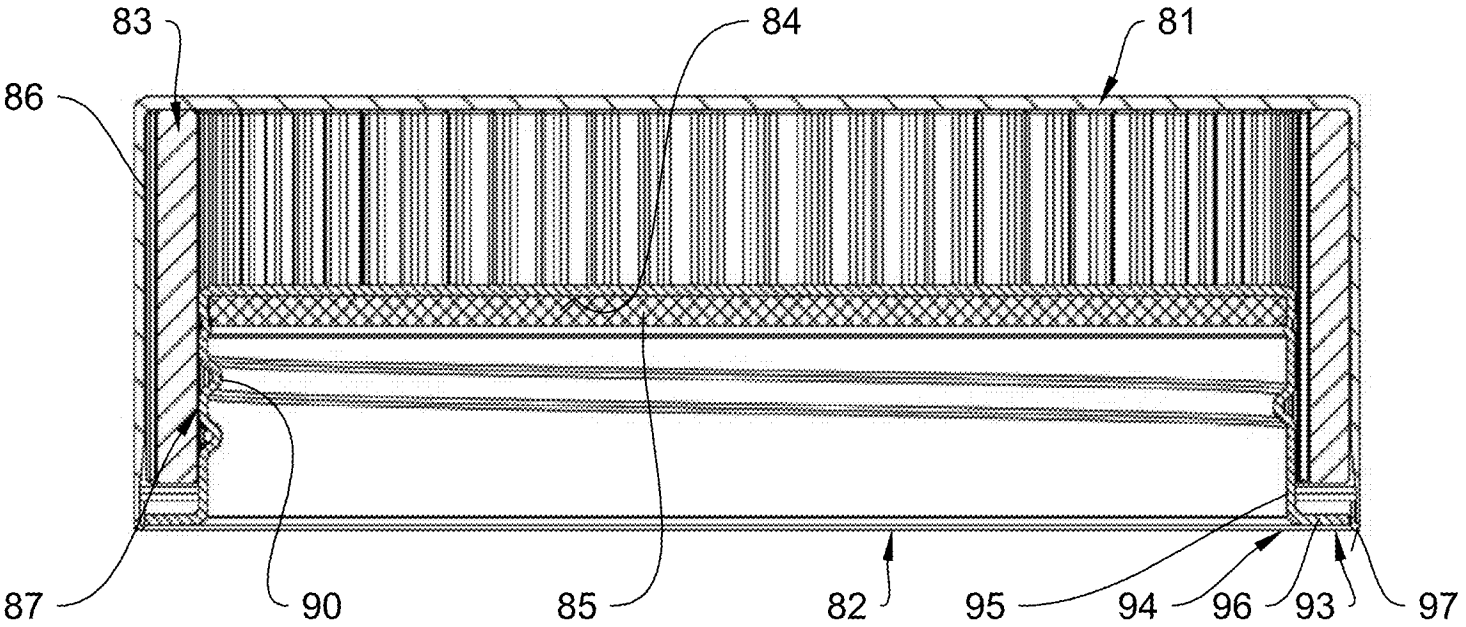
FIG. 3 shows a cross-sectional view of the closing cap arrangement shown in FIG. 1.

FIGS. 1 to 3 show a closing cap arrangement 80, which comprises a total of four components, which includes an enveloping cap 81, an inner cap 82 provided with a cap thread 90, a cap insert 83 disposed in a gap between enveloping cap 81 and inner cap 82 and a sealing disk 85 disposed on a cap bottom 84. With the exception of sealing disk 85, all further components of closing cap arrangement 80 are made of metal, in particular aluminium, in this embodiment. It is generally also possible, to make cap insert 83 of a plastic material, in particular in the event when a first radially outer connection 86 between cap insert 83 and enveloping cap 81 and a second radially inner connection 87 between cap insert 83 and inner cap 82 provided with cap thread 90 are realised as a press-fit connection or an adhesive connection.

As FIG. 2 shows, cap insert 83 is designed like a sleeve, ribs being provided in the instance of this embodiment, which extend parallel to the centre axis of cap insert 83 on its inner and/or outer contact surface. In the event that connections 86 and 87 are realised as adhesive connections, ribs 91, 92 enable enlarging the adhesive surface on jacket surfaces 88, 89.

For realising a connection 93 between a radial connective edge 94 of a connective collar 96 formed on an opening edge 95 of inner cap 82 and a lower edge 97 of enveloping cap 91, a crimping connection, an adhesive connection or a welded connection can be provided.

For fixating sealing disk 85 on cap bottom 84 of inner cap 82, a locking connection is intended in such a manner that the diameter of sealing disk 85 is slightly larger than the inner diameter of inner cap 82 defined by a locking groove formed adjacent to cap bottom 84 in inner cap 82.

In the case of the same material being chosen for enveloping cap 81, inner cap 82 and cap insert 83, the material preferably being aluminium, plastic sealing disk 85 only has to be taken out of the locking connection to inner cap 82 so that the other cap components can be recycled together.

Figure 4:
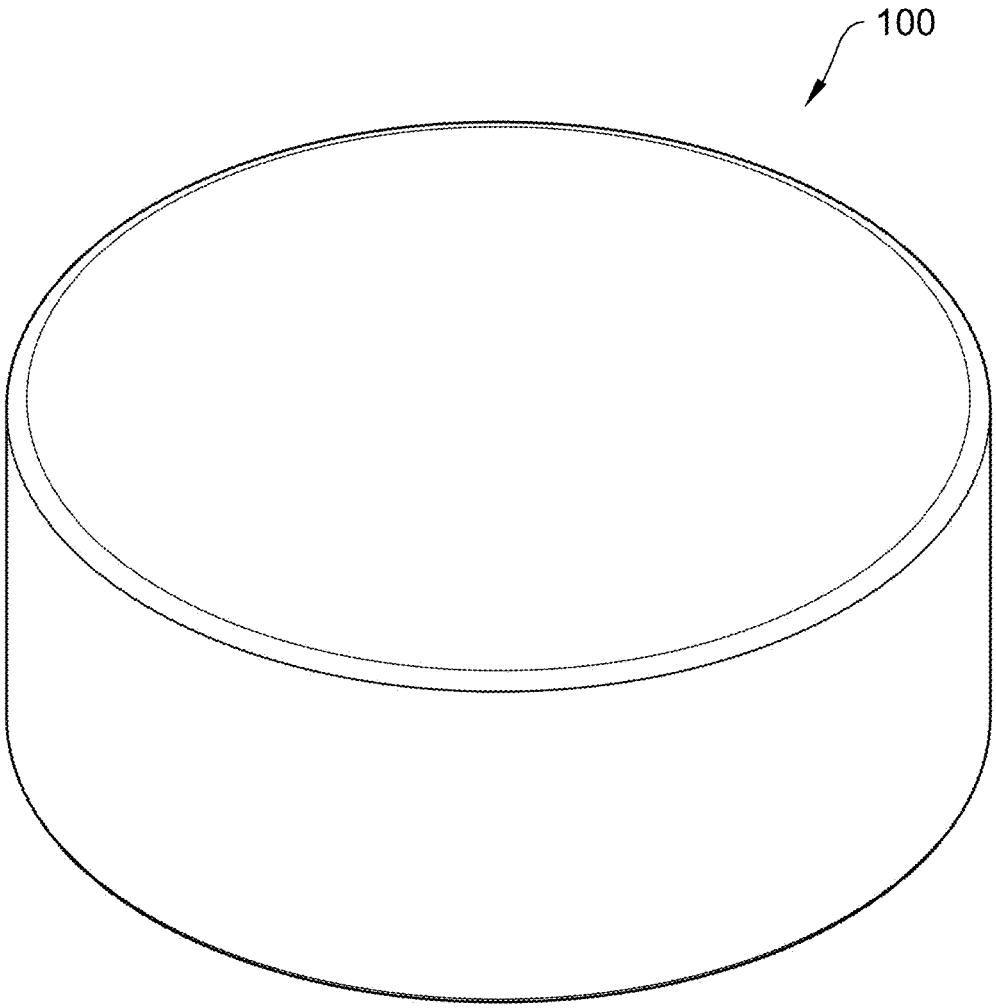
FIG. 4 shows an isometric view of a closing cap arrangement according to another embodiment.
Figure 5:
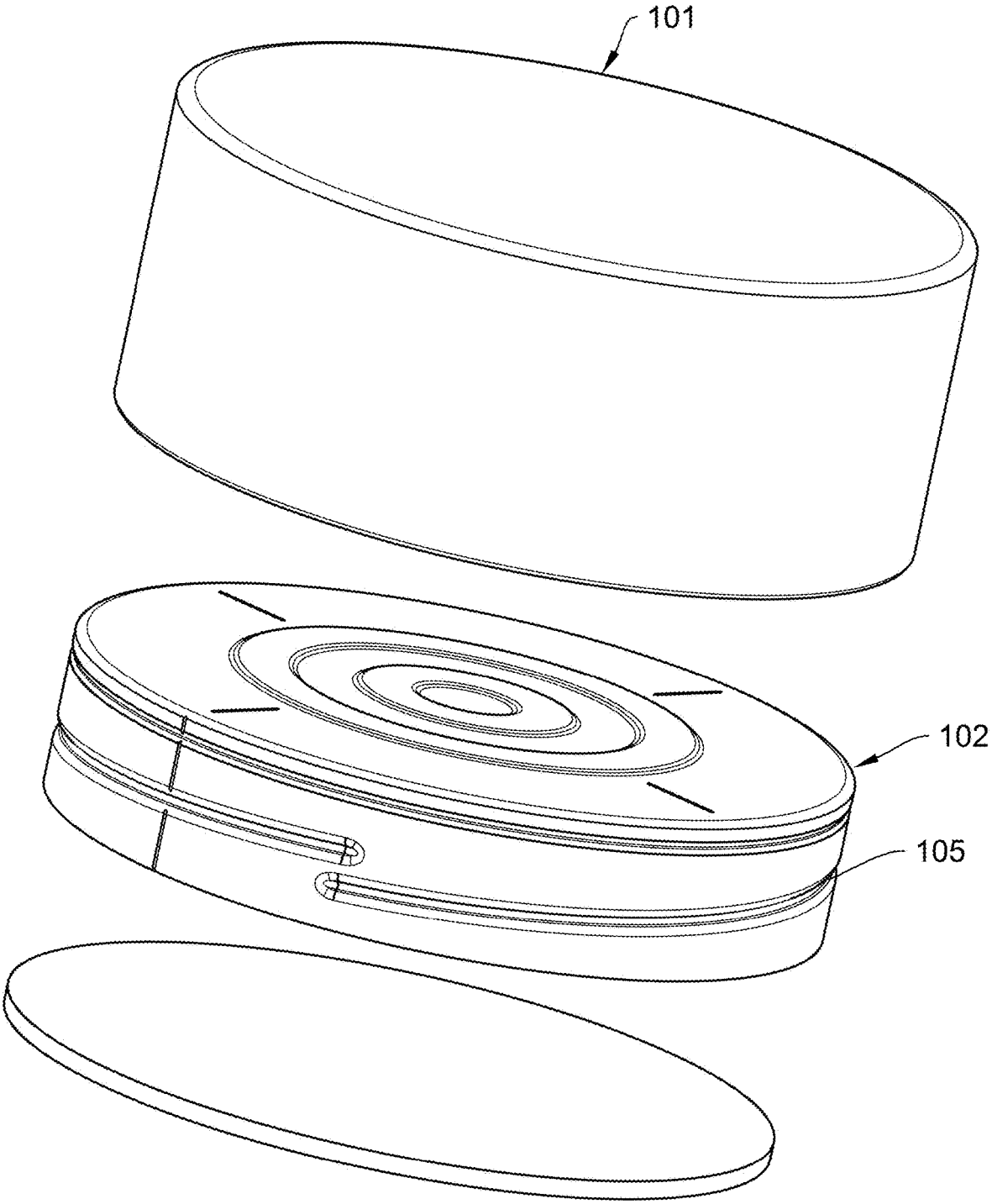
FIG. 5 shows an exploded view of the closing cap arrangement shown in FIG. 4.
Figure 6:
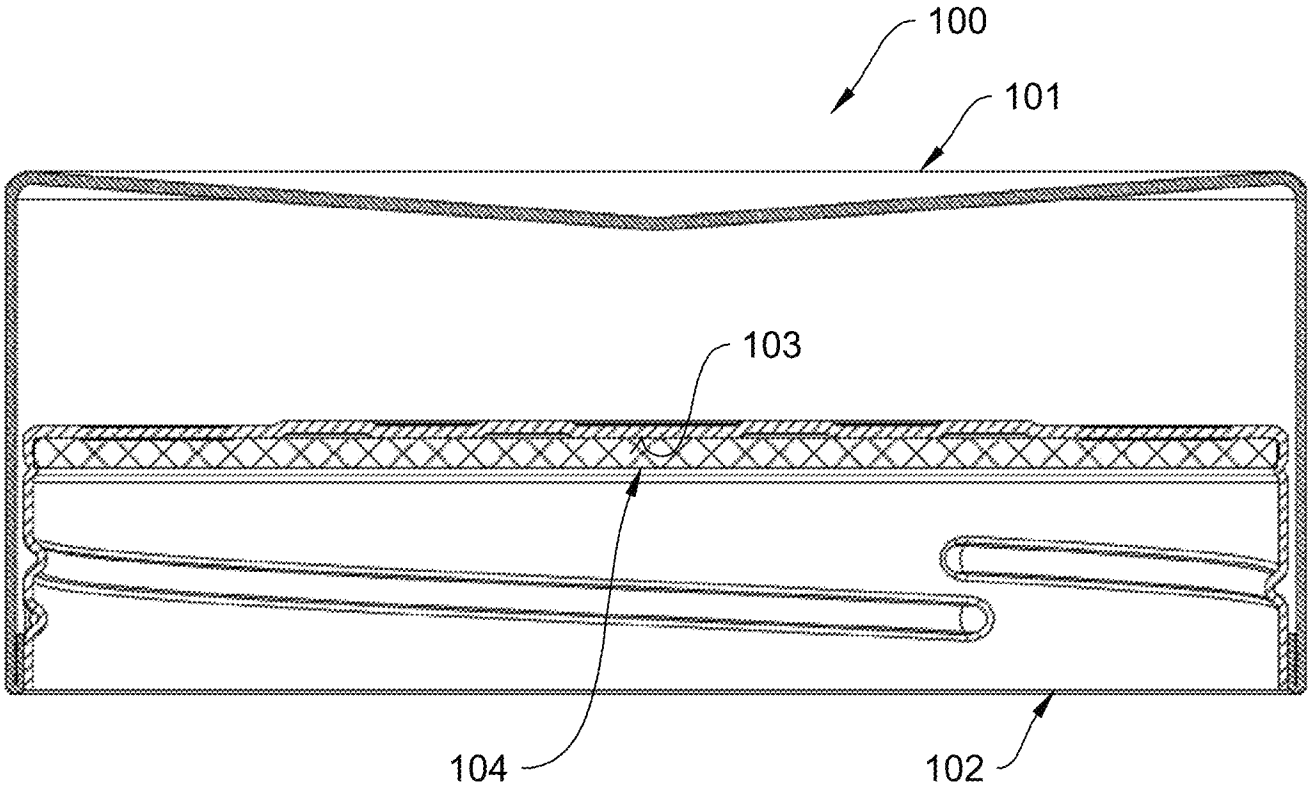
FIG. 6 shows a cross-sectional view of the closing cap arrangement shown in FIG. 4.
Figure 7:
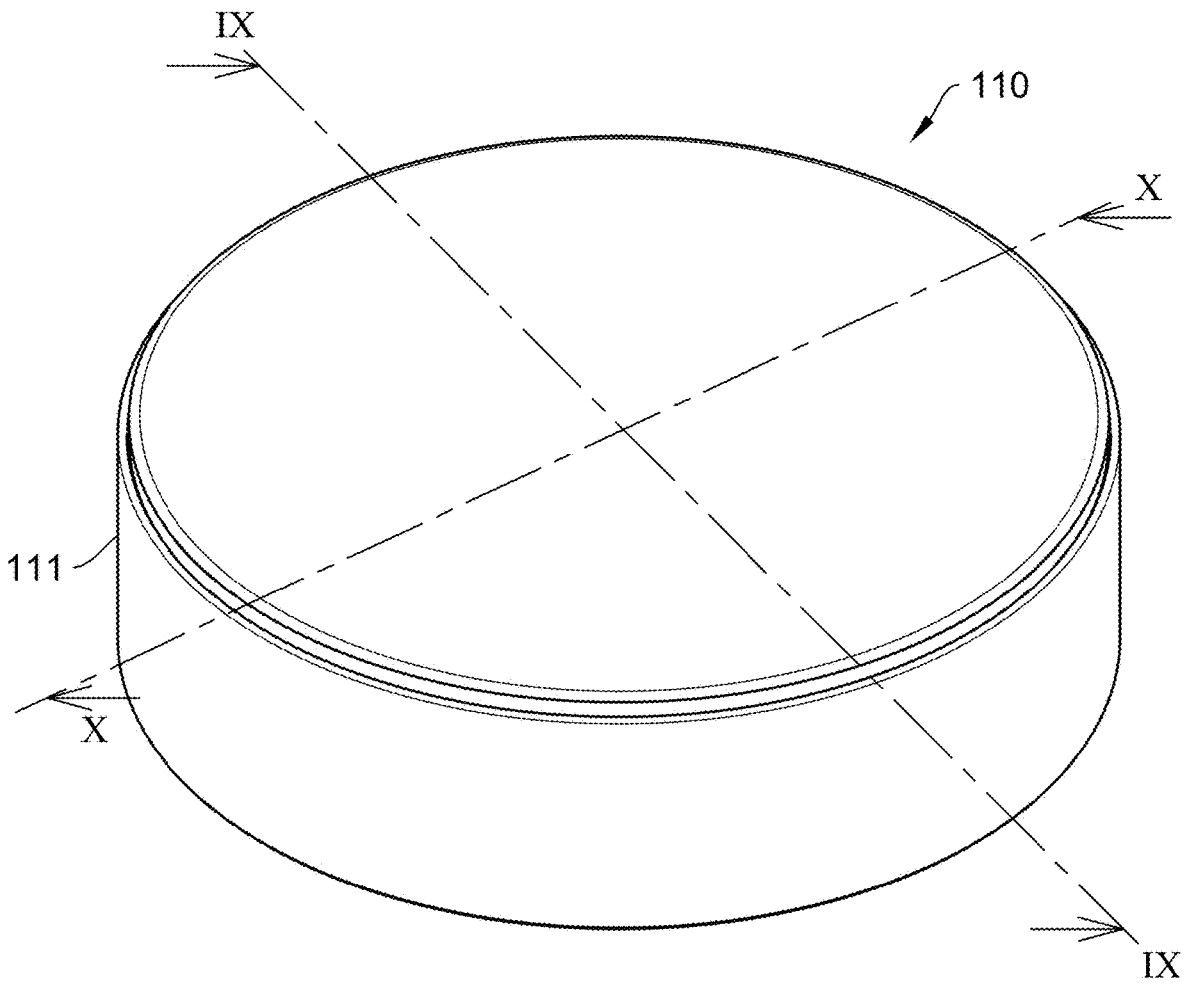
FIG. 7 shows an isometric view of a closing cap arrangement according to another embodiment.
Figure 8:
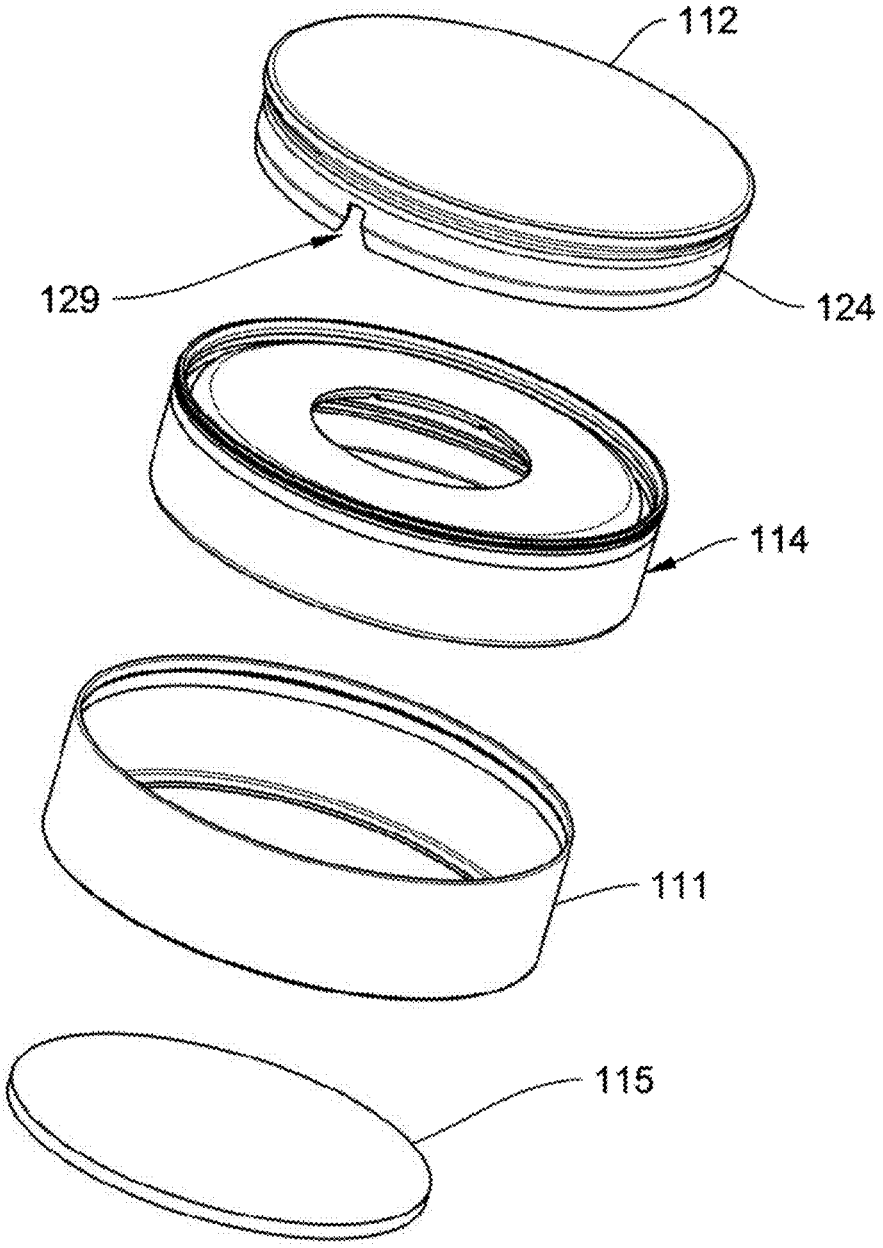
FIG. 8 shows an exploded view of the closing cap arrangement shown in FIG. 7.
Figure 10:
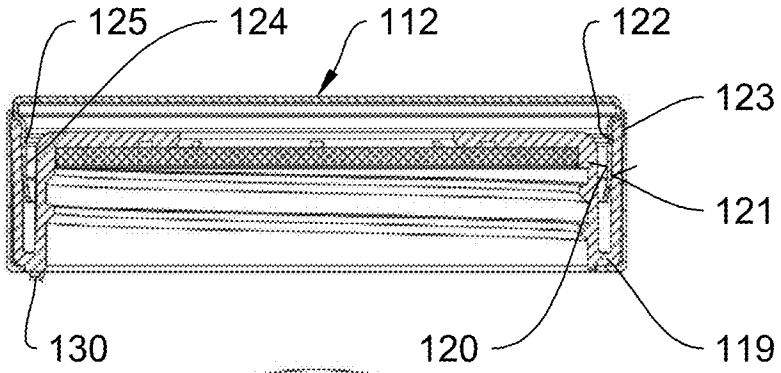
FIG. 10 shows a cross-sectional view along cutting plane X-X of the closing cap arrangement shown in FIG. 7.
Figure 9:
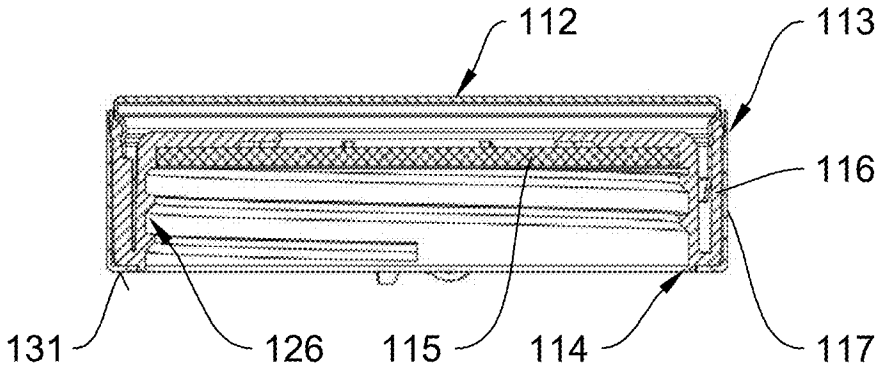
FIG. 9 shows a cross-sectional view along cutting plane IX-IX of the closing cap arrangement shown in FIG. 7.
Figure 11:
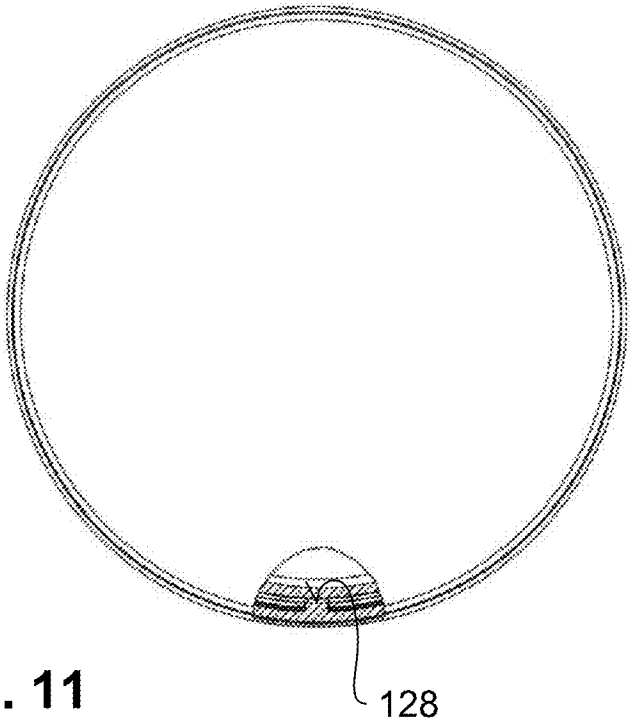
FIG. 11 shows a partial cross-sectional view from the top of the closing cap arrangement shown in FIG. 7.

Closing cap arrangement 100 shown in FIGS. 4 to 6 comprises only one enveloping cap 101, an inner cap 102 provided with a cap thread 105 and a sealing disk 104 disposed on a cap bottom 103 of inner cap 102. Enveloping cap 101 and inner cap 102 are each connected to each other by their lower edge via concentric contact surfaces, the connection being able to be realised as a press-fit connection, an adhesive connection or a welding connection.

Closing cap arrangement 110 shown in FIGS. 7 to 11 is made up of overall four components, namely an enveloping cap 113 made up of a jacket envelope 111 and a cap bottom 112 and an inner cap 114, which in contrast to enveloping cap 113, which is made of metal, in particular aluminium, is made of a plastic material and has a sealing disk 115 inserted into inner cap 114.

For closing cap arrangement 110, plastic inner cap 114 takes over the function of a connective element for connecting jacket envelope 111 to cap bottom 112 besides providing a cap thread 126, jacket envelope 111 and cap bottom 112 together forming enveloping cap 113. For realising this connective function, a connective sleeve 117 is formed on the peripheral edge of a cap base 116 provided with cap thread 126, connective sleeve 117 extending concentrically of the cap base 116 and being connected to the cap base 116 only via a radial web 119 formed on the lower edge of cap base 116. On the free end of connective sleeve 117, connective sleeve 117 is provided with a circumferential locking groove 122 and/or a locking protrusion 123 on both an inner side 120 and an outer side 121 in such a manner that a locking groove 125 formed on an edge web 124 of cap bottom 112 locks with locking groove 122 if edge web 124 of cap bottom 112 is inserted into a gap formed between cap base 116 and connective sleeve 117.

Jacket envelope 111 and inner cap 114 are connected in such a manner that jacket envelope 111 is pushed onto connective sleeve 117 of inner cap 114 until an edge seam 127, which is formed on jacket envelope 111, locks behind locking protrusion 123.

For forming an anti-rotation element between cap bottom 112 and inner cap 114, a locking web 128, which is formed parallel to the cap axis and locks with locking groove 129 formed in edge web 124 of cap bottom 112, is provided on inner side 120 of connective sleeve 117. Another anti-rotation element is formed between radial web 119 of inner cap 114 and a lower edge 131 of jacket envelope 111 in such a manner that a locking protrusion 130 formed on radial web 119 engages into a locking opening of jacket envelope 111. Moreover, locking protrusion 130 serves as an orientation abutment of the cap with respect to a pot not illustrated in this instance.

Figure 12:
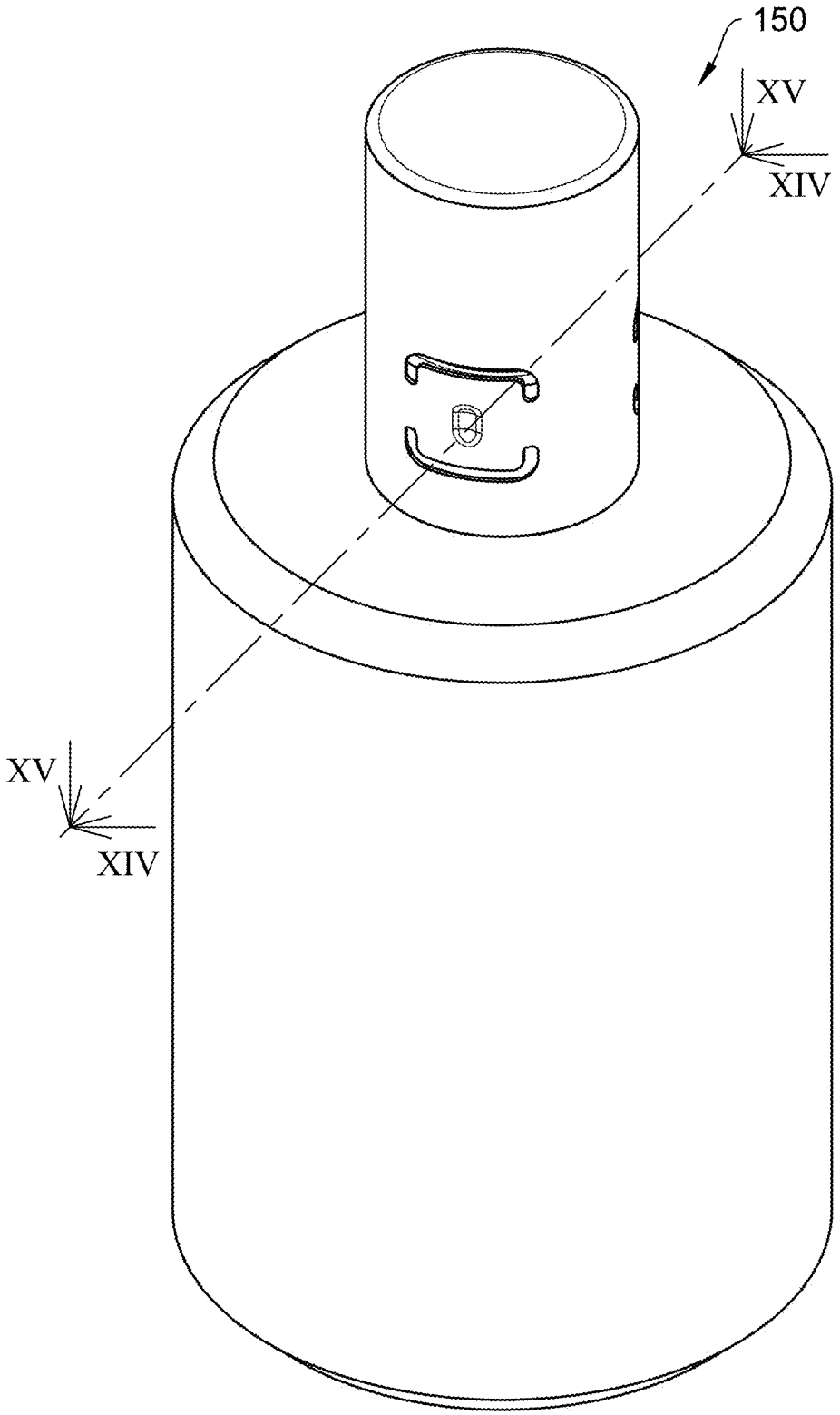
FIG. 12 shows an isometric view of a closing cap arrangement according to another embodiment.
Figure 34:
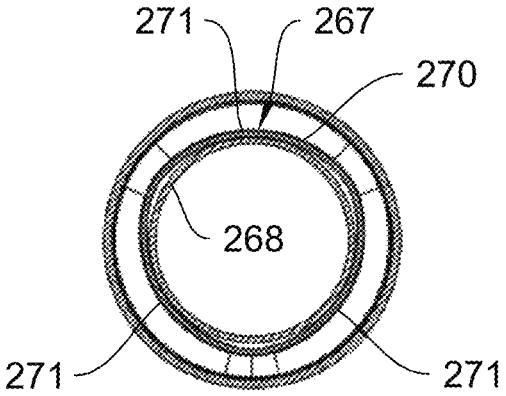
FIG. 34 shows a cross-sectional view along cutting plane XXXIVXXXIV of the closing cap arrangement shown in FIG. 31.

In FIGS. 12 and 34, different embodiments of closing cap arrangements 141, 142, 143, 144, 145 and 146 having push-on caps 150, 170, 200, 220, 240 and 260 are illustrated, which as illustrated by the exemplary embodiment in FIG. 12 preferably are intended for being positioned on a collar 151, which is disposed on a bottle neck of a vessel realised as a glass bottle, for example. Collar 151 typically serves for cover a dosing pump, which is disposed in or on the bottle neck and serves for dispensing a liquid, such as in particular perfume, received in the bottle.

Figure 13:
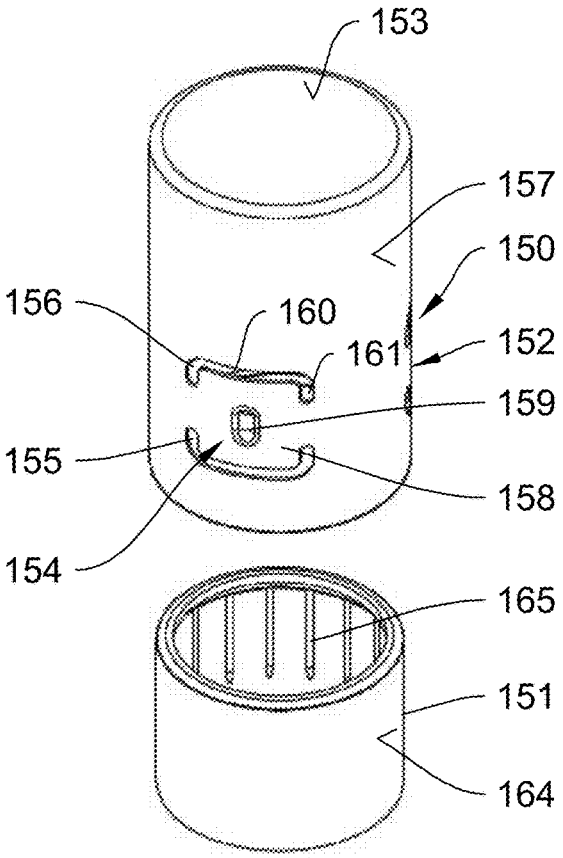
FIG. 13 shows an exploded view of the closing cap arrangement shown in FIG. 12.
Figure 15:
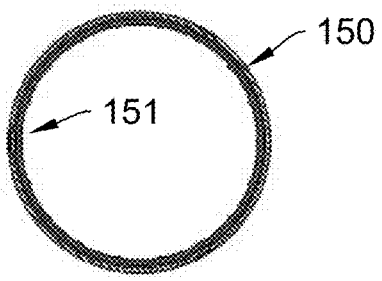
FIG. 15 shows a cross-sectional view along cutting plane XV-XV of the closing cap arrangement shown in FIG. 12.

FIG. 13 shows an exploded view of push-on cap 150 which is pulled off collar 151 and, as shown in FIGS. 13 and 15, is connected to collar 151 via a clamp connection when disposed on collar 151.

As a synopsis of FIGS. 13 and 15 shows, push-on cap 150 is sleeve-shaped and comprises a sleeve part 152, which is provided with a cap bottom 153 on an end. Sleeve part 152 comprises spring cams 154, which are distributed across the circumference of sleeve part 152 and each comprise a cam base 158, which is divided by two opposite slots 155, 156 in a sleeve wall 157 and is provided with a cam 159, which is directed radially inward and is formed by an indentation in sleeve wall 157 in this instance.

Slots 155, 156 are preferably realised such that they each comprise a horizontal section 160 extending in the circumferential direction of sleeve part 152 and two vertical sections extending from the ends of horizontal section 160, wherein vertical sections 161 of the horizontal sections 160 and are parallel to each other. The opposite slots 155 and 156 enable cam 159, which is formed on cam base 158, to be moved radially outward against a resilient recoil movement.

As in particular FIG. 13 shows, collar 151 is sleeve-shaped and is provided with a smooth contact surface 164 on its outer surface. On its inner side, collar 151 comprises a plurality of clamping webs 165, which are distributed across the circumference, protrude radially inward and extend vertically. When collar 151 is disposed on a bottle neck (not shown) or on a pumping element of a dosing pump disposed on the bottle neck, clamping webs 165 enable forming a clamping connection between collar 151 and the bottle neck or the pumping element.

Figure 14:
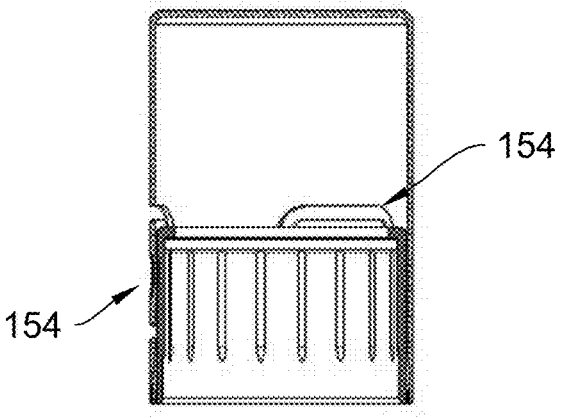
FIG. 14 shows a cross-sectional view along cutting plane XIV-XIV of the closing cap arrangement shown in FIG. 12.

As a synopsis of FIGS. 14 and 15 shows, the clamping connection mentioned above between push-on cap 150 and collar 151 is caused by spring cams 154, which protrude radially inward, abutting against contact surface 164 of collar 151 when pushing push-on cap 150 on collar 151 under preload.

Figure 16:
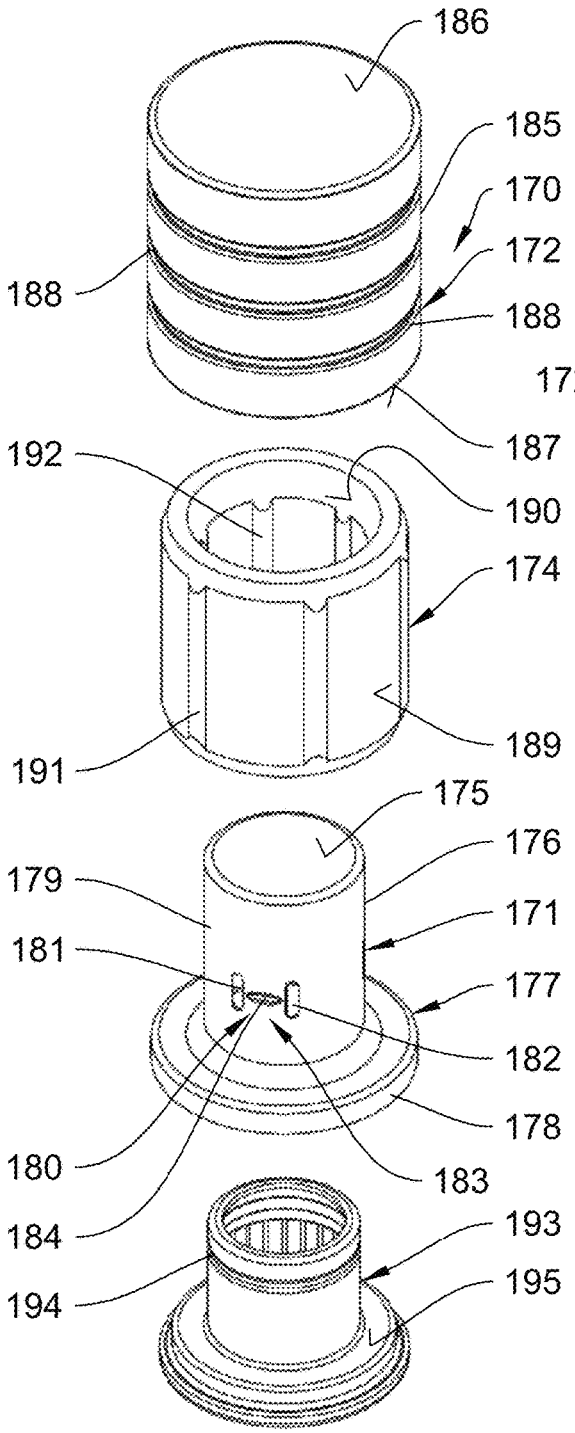
FIG. 16 shows an exploded view of a closing cap arrangement according to another embodiment.
Figure 18:
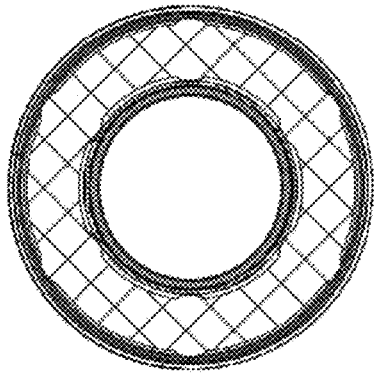
FIG. 18 shows a second cross-sectional view of the closing cap arrangement shown in FIG. 16.
Figure 19:
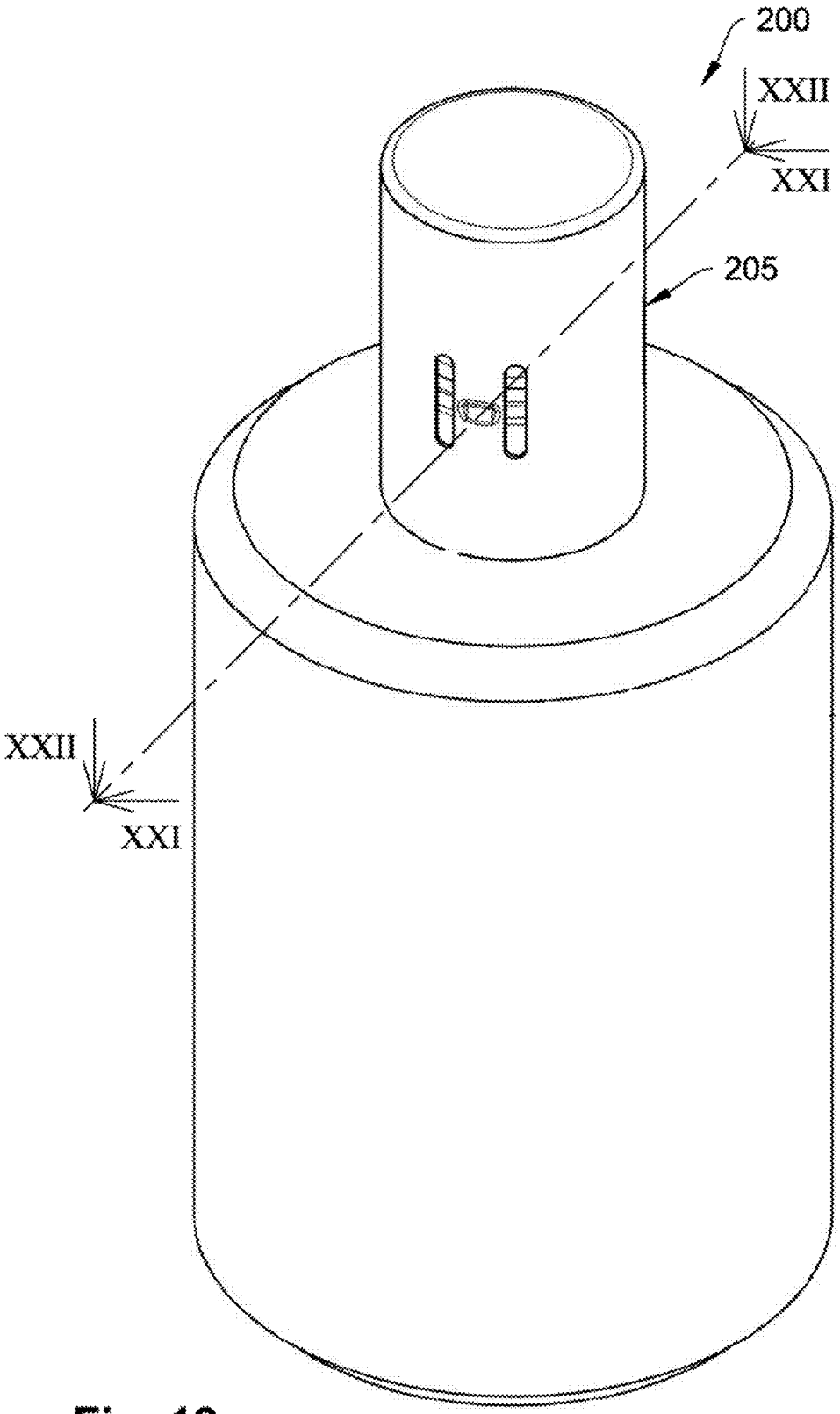
FIG. 19 shows an isometric view of a closing cap arrangement according to another embodiment.

FIGS. 16 and 18 serve for explaining push-on cap 170, which comprises a cap inner part 171, an enveloping cap 172 and a cap insert 174, which is preferably realised as a cap weight and is inserted into a gap 173 formed between cap inner part 171 and enveloping cap 172.

Figure 17:
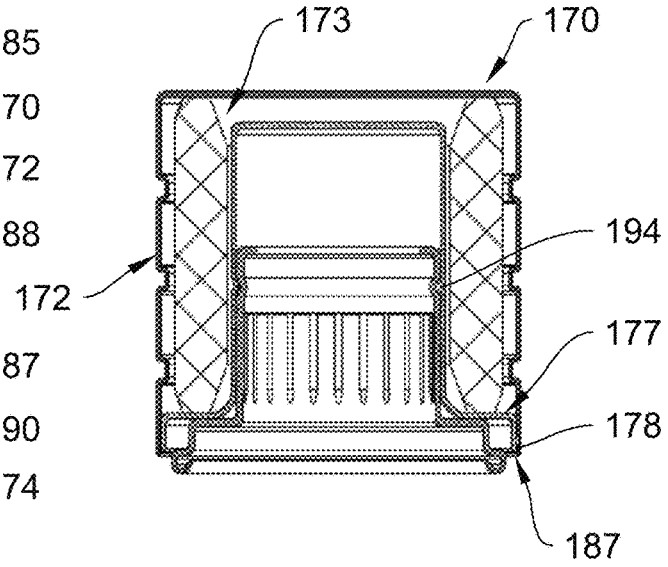
FIG. 17 shows a first cross-sectional view of the closing cap arrangement shown in FIG. 16.

Cap inner part 171 comprises a sleeve part 176, which is provided with a cap bottom 175 on an end and, as in particular FIGS. 16 and 17 show, with a radial collar 177 on its lower end, radial collar 177 crossing over to a circumferential axial edge web 178 on its lower edge.

Sleeve part 176 comprises several spring cams 180 in a sleeve wall 179, the spring cams 180 being distributed across the circumference and each comprising a cam base 183, which is divided by two parallel slots 181, 182, which extend vertically in this instance, in sleeve wall 179 and on which a cam 184 is formed, which protrudes radially inward and is formed by an indentation in the present case.

Enveloping cap 172 is also sleeve-shaped and has a cap bottom 186 formed on the upper end of a sleeve part 185 and an opening edge 187 formed at the lower end.

Cap insert 174 disposed in gap 173 is also sleeve-shaped, ribs 191, 192, which extend in the longitudinal direction of cap insert 174, being formed on both an outer surface 189 and on an inner surface 190 in such a manner that cross sections, in which clamping forces become effective, are formed between horizontal grooves 188 and vertical ribs 191 when cap insert 174 is disposed in gap 173. Likewise, a clamping is carried out between vertical ribs 192 and sleeve wall 179 of cap inner part 171.

Cap inner part 171 and enveloping cap 172 are directly connected between opening edge 187 of enveloping cap 172 and edge web 178 formed on collar 177 of cap inner part 171, this connection selectively being able to be realised as a press-fit connection, an adhesive connection or a welding connection.

As in particular a synopsis of FIGS. 16 and 17 makes clear, push-on cap 170 or cap insert 174 serves for being disposed on a collar 193, which is located on a bottle neck (not shown) or a pumping element of a dosing pump. The collar is provided with a locking groove 194, which extends horizontally and circumferentially and with which spring cams 180 formed on cap inner part 171 lock when pushing push-on cap 170 on. For ensuring a safe locking of cap inner part 171, an axial abutment is formed on collar 193 via a collar ledge 195 protruding outward radially.

FIGS. 19 to 22 show push-on cap 200, whose general design and functioning corresponds to that of cap inner part 171 of push-on cap 170, push-on cap 200 comprising neither a collar 177 nor an edge web 178 at the lower edge of sleeve part 205 unlike cap inner part 171.

Figure 20:
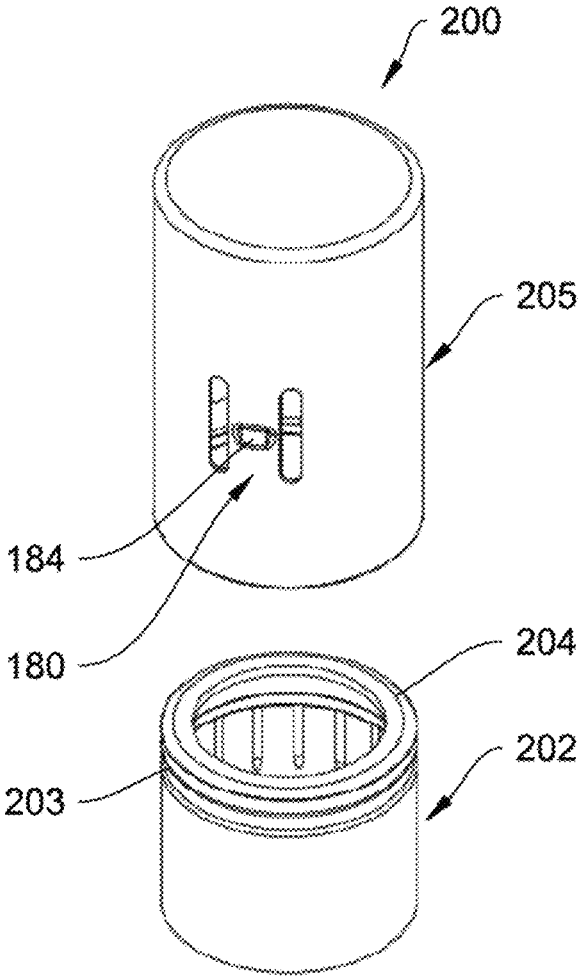
FIG. 20 shows an exploded view of the closing cap arrangement shown in FIG. 19.
Figure 21:
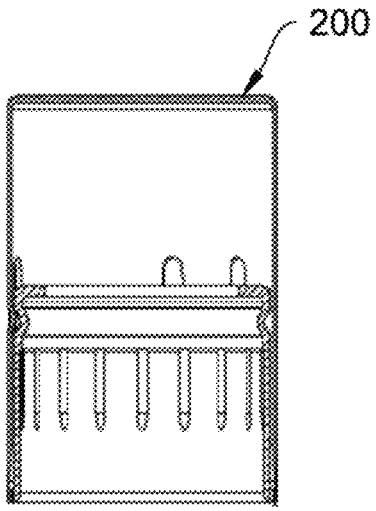
FIG. 21 shows a cross-sectional view along cutting plane XXI-XXI of the closing cap arrangement shown in FIG. 19.

Push-on cap 200 serves for the locked arrangement on a collar 202, which is shown in FIGS. 20 and 21 and which does not comprise a collar ledge unlike collar 193 illustrated in FIG. 16, for example, which serves for being combined with push-on cap 170 provided with cap inner part 171.

Figure 22:
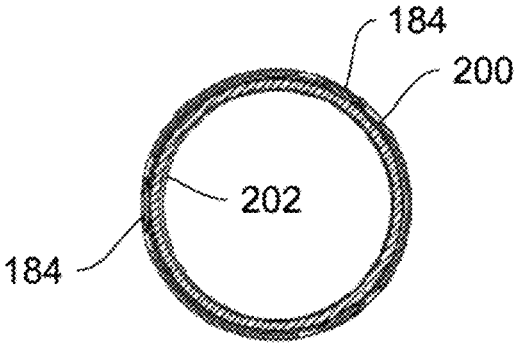
FIG. 22 shows a cross-sectional view along cutting plane XXII-XXII of the closing cap arrangement shown in FIG. 19.
Figure 23:
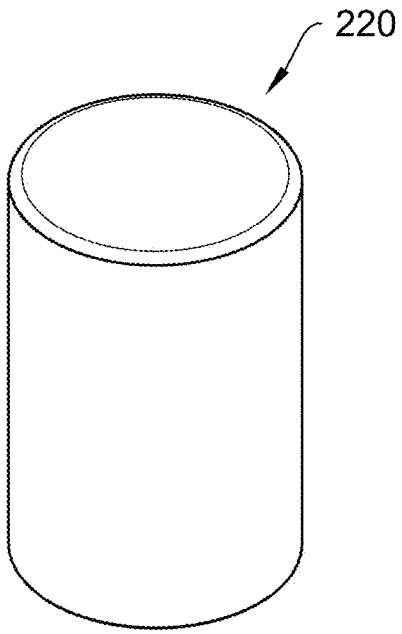
FIG. 23 shows an isometric view of a closing cap arrangement according to another embodiment.

Beyond this, a locking connection between push-on cap 200 and collar 202, which is provided with a horizontally circumferential locking groove 203 consistent with collar 193, is realised in such a manner that, as illustrated in FIGS. 21 and 22, cams 184, which are formed on spring cams 180, lock with locking groove 203 when push-on cap 200 is pushed onto collar 202 if spring cams 180 spring into locking groove 203 after an elastic deformation, which is caused by an upper opening edge 204 and is directed radially inward, upon reaching locking groove 203.

Figure 24:
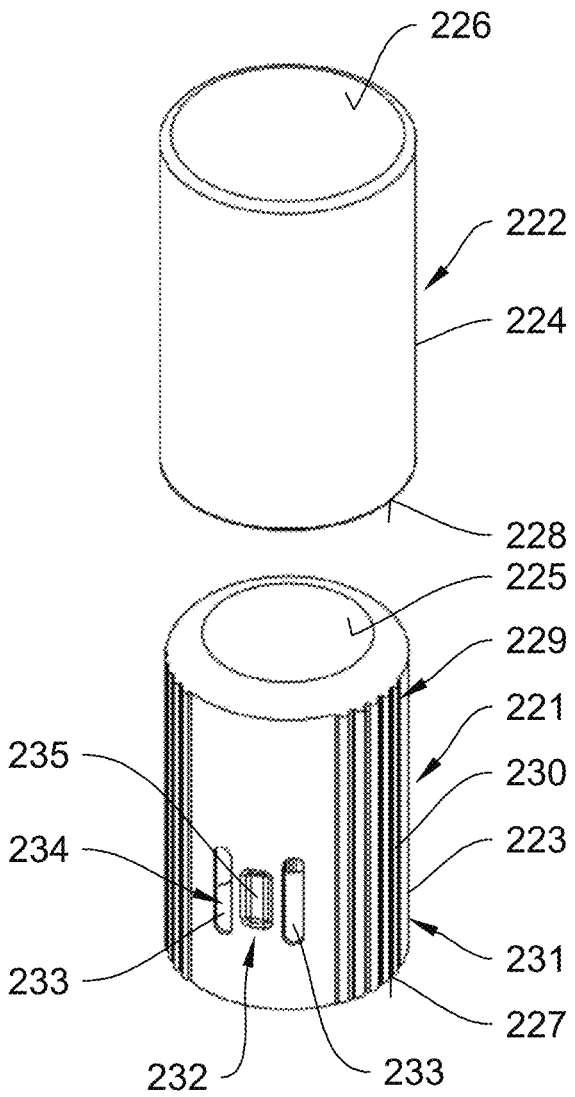
FIG. 24 shows an exploded view of the closing cap arrangement shown in FIG. 23.
Figure 25:
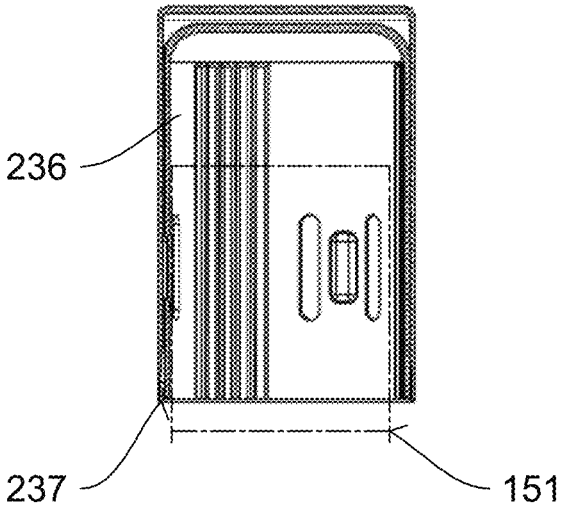
FIG. 25 shows a cross-sectional view along cutting plane XXV-XXV of the closing cap arrangement shown in FIG. 23.
Figure 26:
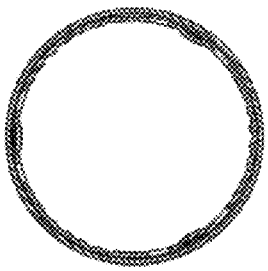
FIG. 26 shows a cross-sectional view along cutting plane XXVI-XXVI of the closing cap arrangement shown in FIG. 23.
Figure 27:
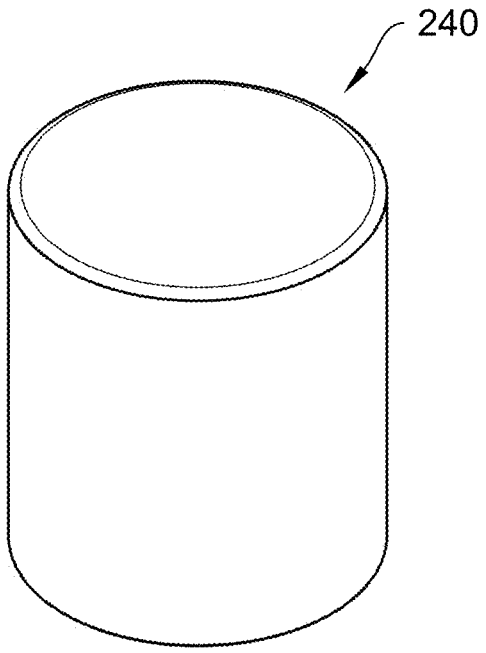
FIG. 27 shows an isometric view of a closing cap arrangement according to another embodiment.

In FIGS. 23 to 26, another embodiment of push-on cap 220 is shown, which, as is shown in particular in FIGS. 24 to 26, comprises a cap inner part 221 and an enveloping cap 222, which each comprise a sleeve part 223, 224, which are closed at one end by a cap bottom 225 and 226, respectively, and comprise a cap opening having an opening edge 227 and 228, respectively, which are formed by a lower edge of sleeve part 223 and 224, respectively, on respective opposite ends.

Cap inner part 221 comprises spacing elements 229, which protrude radially outward and are distributed across the circumference of a sleeve wall 231 and are formed, in this instance, from a plurality of ribs 230 extending parallel to each other in the longitudinal direction of sleeve part 223. In wall areas of sleeve wall 231, which are each disposed between to spacing elements 229, a spring cam 232 is formed, which comprises a cam 235, which protrudes radially inward and is shown in particular in FIGS. 25 and 26, on a cam base 234, which is divided by two parallel slots 233, which extend in the longitudinal direction of sleeve part 223 in the instance at hand and are located in sleeve wall 231. As FIG. 25 shows, sleeve wall 231 of sleeve part 223 is equipped with three spacing elements 229 distributed equidistantly across the circumference and also comprises three spring cams 232 each disposed between two spacing elements 229 and distributed equidistantly across the circumference.

To elucidate the function of spring cams 232, the contour of a collar 151 (FIG. 13) is shown by a chain dotted line, collar 151 being equipped with a smooth outer jacket surface. For disposing push-on cap 220 on collar 151, the mechanical assembly, which is made up of cap inner part 221 and enveloping cap 222 and with which enveloping cap 222 is preferably produced via a frictional connection between spacing elements 229 and a sleeve wall 236, is pushed onto collar 151, spring cams 232 elastically escaping into a spring space, which is formed between spring cams 232 and sleeve wall 236 of enveloping cap 222, while producing a preload force acting radially inward. Push-on cap 220 is secured on the collar by the spring force exerted by spring cams 232 on collar 151 and can be disposed on or be removed from the collar by overcoming the spring force. The connection between cap inner part 221 and enveloping cap 222 can also be an adhesive connection or a welding connection.

In FIGS. 27 to 30, push-on cap 240 is shown in another embodiment, which comprises a cap inner part 241 and an enveloping cap 242 in the instance of the presently illustrated embodiment, enveloping cap 242 comprising a sleeve part 243 having a uniform diameter, which is closed on one end by a cap bottom 244 and comprises a cap opening having an opening edge 245 on its opposite end. Cap inner part 241 comprises a sleeve part 246 having a tiered diameter, such that a first sleeve ledge 250 is formed in the cross over area from a first sleeve section 248 closed by a cap bottom 247 on one end to a second sleeve section 249 larger in diameter, and such that a second sleeve ledge 252 is formed in the cross over area from sleeve section 249 to an opening edge 251 at a radially outward offset. In the present instance, the connection between cap inner part 241 and enveloping cap 242 can take place between opening edges 245 and 251 by producing a welding connection, press-fit connection or adhesive connection.

Figure 28:
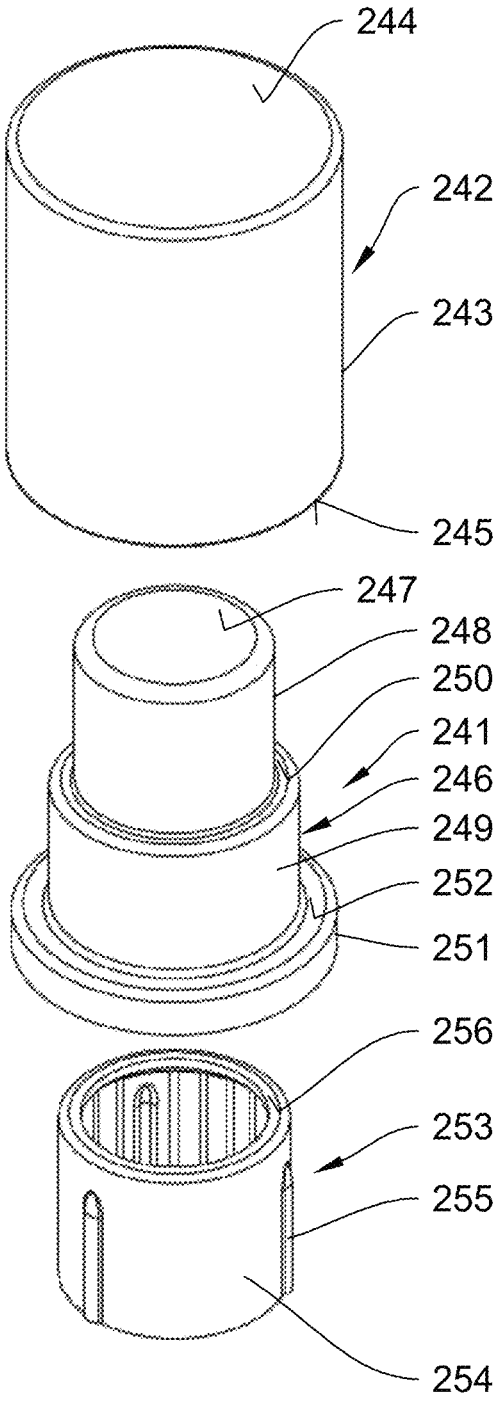
FIG. 28 shows an exploded view of the closing cap arrangement shown in FIG. 27.
Figure 29:
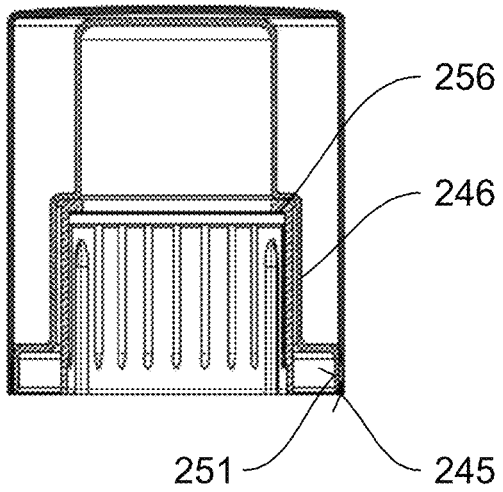
FIG. 29 shows a cross-sectional view along longitudinal cutting plane XXIX-XXIX of the closing cap arrangement shown in FIG. 27.
Figure 30:
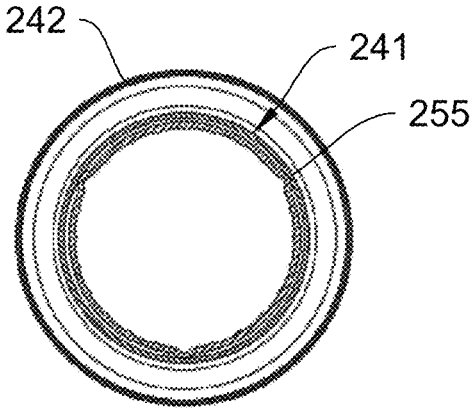
FIG. 30 shows a cross-sectional view along cutting plane XXX-XXX of the closing cap arrangement shown in FIG. 27.
Figure 31:
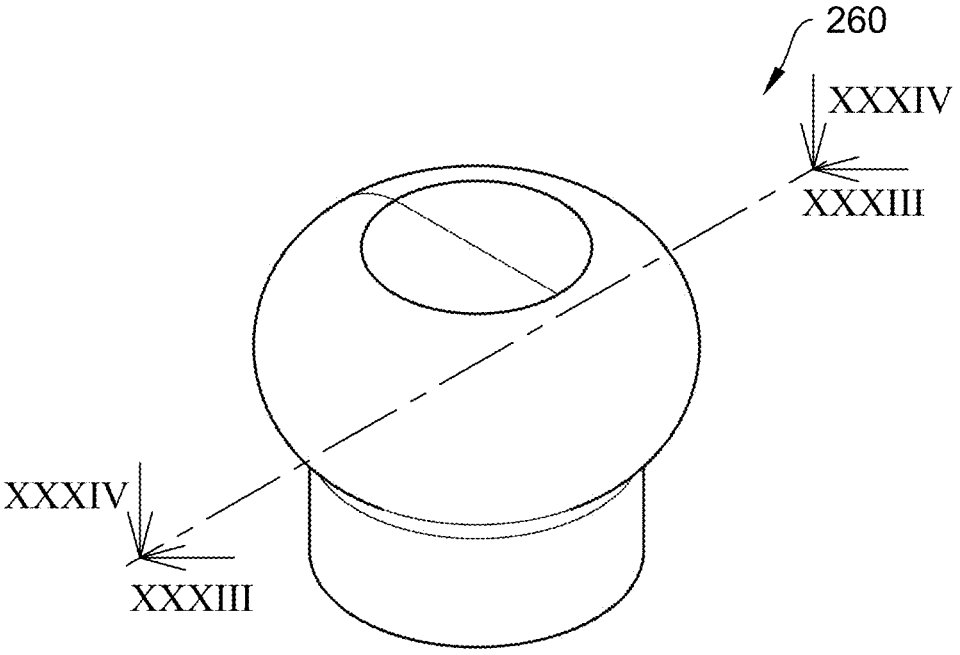
FIG. 31 shows an isometric view of a closing cap arrangement according to another embodiment.
Figure 32:
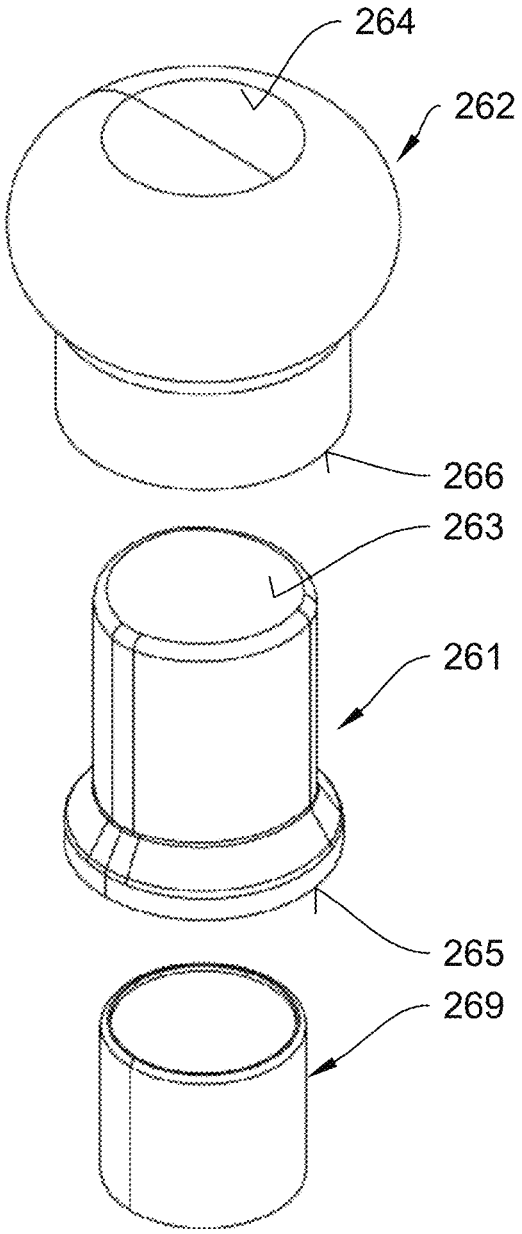
FIG. 32 shows an exploded view of the closing cap arrangement shown in FIG. 31.

For fixedly disposing push-on cap 240 on a collar 253, sleeve-shaped collar 253 is equipped with a plurality of clamping webs 255, which are distributed across the circumference of a sleeve wall 254, on the outer side of sleeve wall 254, clamping webs 255 protruding radially outward from sleeve wall 254, as in particular FIGS. 28 to 30 show, so that clamping forces are produced between sleeve part 246 of cap inner part 241 or sleeve section 249 and the in this instance three clamping webs 255 when disposing push-on cap 240 on collar 253.

As in particular FIG. 29 shows, sleeve ledge 250 formed between sleeve section 248 and sleeve section 249 serves as an axial abutment against an upper collar edge 256 when push-on cap 240 is disposed on collar 253.

Figure 33:
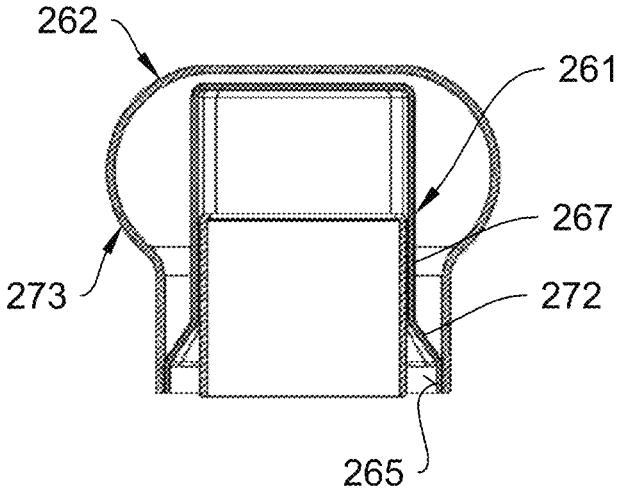
FIG. 33 shows a cross-sectional view along longitudinal cutting plane XXXIII-XXXIII of the closing cap arrangement shown in FIG. 31.

In FIGS. 31 to 34, another embodiment of push-on cap 260 is shown, which, as shown in particular in FIGS. 33 and 34, comprises a cap inner part 261 and an enveloping cap 262, both cap inner part 261 and enveloping cap 262 being sleeve-shaped and each being closed on one end by a cap bottom 263 and 264, respectively, and each being equipped with an opening edge 265 and 266, respectively, on opposing ends. For forming a mechanical connection forming push-on cap 260 in its entirety, cap inner part 261 and enveloping cap 262 are connected to each other on their opening edges 265, 266 disposed concentrically to each other by means of a press-fit connection, an adhesive connection or a welding connection.

As in particular a synopsis of FIGS. 33 and 34 makes clear, cap inner part 261 is formed in an upper sleeve section as a clamping sleeve 267, which has a clamping cross section 270 whose contour deviates from a circular cross section 268 of a collar 269, on which push-on cap 260 is disposed, and which preferably comprises three flattenings 271, which are formed on cross-sectional sections distributed across the circumference, so that the diameter of the clamping cross section is smaller in the area of the flattening than the outer diameter of collar 269.

In the case at hand, clamping cross section 270 is formed beginning from a circular shape by flattenings 271 being deformed radially inwards starting from an inner diameter, which is larger than the outer diameter of collar 269, so that corresponding clamping forces act on collar 269 in the area of flattenings 271, the clamping forces enabling a clamping fixation of push-on cap 260 on collar 269.

As FIG. 33 shows, a cross over section 272, which enables the cross-sectional cross over from a circular cross section in the area of opening edge 265 to clamping cross section 270 of clamping sleeve 267 shown in FIG. 34, is formed for forming a cross-sectional cross over from opening edge 265 of cap inner part 261 to the clamping sleeve provided with clamping cross section 270.

For a better handling of push-on cap 260, which in particular enables pulling push-on cap 260 off of collar 269, an upper handle part of enveloping cap 262 is equipped with a handle protrusion 273, which protrudes radially outward with respect to opening edge 266 and is realised in the present instance by forming a knob part.

The invention claimed is:

1. An assembly of a closing cap and a collar (80, 100, 110, 141, 142, 143, 144, 145, 146) for being disposed on an outlet opening of a vessel realised as a pot or a bottle, the assembly having a multipart design and being embodied as a push-up cap comprising an enveloping cap (81, 101, 113, 172, 222, 242, 262) and an inner cap (82, 102, 114) detachably connecting the closing cap to the collar, which is realized as a sleeve and serves for being disposed on the outlet opening or on a dispense element disposed in the outlet opening, wherein the inner cap and the enveloping cap are connected to each other via a detachable connection realised as a form-fit, substance-to-substance or force-fit connection, wherein the inner cap is connected to the collar via a sleeve part having at least one spring cam (154, 180, 232), which comprises two opposite slots (155, 156, 181, 182, 233), which are disposed in a wall of the sleeve part for forming a cam base and a cam (159, 184, 235), which is directed radially inward on the cam base;

wherein the collar (193) is equipped with a locking groove (194), which extends circumferentially and is directed radially inward and serves for locking with the at least one spring cam (180) disposed in the sleeve part of the push-up cap (170); and wherein a sleeve-shaped cap insert (174) is received in a gap (173) formed between the inner cap (171) and the enveloping cap (172), the cap insert (174) connecting the enveloping cap (172) to the inner cap (171), and wherein the cap insert (174) comprises vertical ribs (191, 192) on both its inner surface and its outer surface.

2. The assembly according to claim 1, characterised in that the enveloping cap (81, 101, 113) and the inner cap (82, 102, 114) are each connected to each other by their lower edge via concentric contact surfaces.

3. The assembly according to claim 1, wherein the cam (159, 184, 235) is formed by an indentation in the wall of the sleeve part.

4. The assembly according to claim 1, wherein the slots (181, 182) extend vertically.

5. The assembly according to claim 1, wherein the push-up cap (150, 170, 200, 220) comprises several spring cams (154, 180, 232).

6. The assembly according to claim 1, wherein the enveloping cap (172) comprises at least one horizontal circumferential groove (188), which protrudes radially inward, on a sleeve part in such a manner that crossings are formed between the at least one horizontal circumferential groove and the ribs (191, 192) because of the arrangement of the cap insert in the gap.

* * * * *